US008634953B2

(12) United States Patent
Söderlund

(10) Patent No.: US 8,634,953 B2
(45) Date of Patent: Jan. 21, 2014

(54) METHOD AND EQUIPMENT FOR FLATNESS CONTROL IN COOLING A STAINLESS STEEL STRIP

(75) Inventor: Stephan Söderlund, Torshälla (SE)

(73) Assignee: Outokumpu OYJ, Espoo (FI)

( * ) Notice: Subject to any disclaimer, the term of this patent is extended or adjusted under 35 U.S.C. 154(b) by 714 days.

(21) Appl. No.: 12/673,962

(22) PCT Filed: Jun. 27, 2008

(86) PCT No.: PCT/FI2008/050394
§ 371 (c)(1),
(2), (4) Date: Feb. 17, 2010

(87) PCT Pub. No.: WO2009/024644
PCT Pub. Date: Feb. 26, 2009

(65) Prior Publication Data

US 2011/0208345 A1 Aug. 25, 2011

(30) Foreign Application Priority Data

Aug. 17, 2007 (FI) ..... 20070622

(51) Int. Cl.

| | |
|---|---|
| ***B21B 1/08*** | (2006.01) |
| ***B21B 27/06*** | (2006.01) |
| ***B21B 37/16*** | (2006.01) |
| ***C21D 1/54*** | (2006.01) |
| ***C21D 6/00*** | (2006.01) |
| ***C21D 9/00*** | (2006.01) |
| ***C21D 8/02*** | (2006.01) |
| ***G05B 13/02*** | (2006.01) |
| ***G06F 19/00*** | (2011.01) |

(52) U.S. Cl.
USPC ..... 700/153; 700/28; 700/154; 72/8.2; 72/199; 72/201; 148/508; 148/510; 148/511; 148/534; 148/559; 148/660; 148/661; 148/664

(58) Field of Classification Search
USPC ..... 700/153, 154, 28; 72/8.2, 201, 199; 148/508, 510, 511, 660, 661, 664, 534, 148/559
See application file for complete search history.

(56) References Cited

U.S. PATENT DOCUMENTS 4,248,072 A * 2/1981 Hasegawa et al. ..... 72/8.3
4,274,273 A * 6/1981 Fapiano et al. ..... 72/8.5

(Continued)

OTHER PUBLICATIONS

Sengupta, J. et al. (2005). The use of water cooling during the continuous casting of steel and aluminum alloys. Metallurgical and Materials Transactions A, vol. 36A(Issue 1), pp. 187-204. Retrieved from http://link.springer.com/article/10.1007%2Fs11661-005-0151-y#.*

(Continued)

*Primary Examiner* — Mohammad Ali
*Assistant Examiner* — Jennifer L Norton
(74) *Attorney, Agent, or Firm* — Chernoff Vilhauer McClung & Stenzel LLP

(57) ABSTRACT

The invention relates to a method and equipment for controlling flatness of a stainless steel strip in connection with cooling after annealing in a finishing line. The strip (1) is first in the direction of the strip movement (2) cooled feeding at least one cooling medium through at least one group of feeding devices (5, 6) located transversally to the direction of the strip movement for the whole width of the strip (1), the amount of the cooling medium being adjusted utilizing the recorded and predetermined data (7) of desired temperature of the strip for flatness, the temperature of the strip is then determined (8) and after the temperature determination a further step of cooling is carried out feeding at least one cooling medium through at least one group of feeding devices (9) located transversally to the direction of the strip movement (2), when the determined value of temperature is different from the predetermined value of temperature, before the flatness is controlled using a control device (11) containing a plurality of flatness control units (12) and locating transversally to the direction of the strip movement (2).

17 Claims, 2 Drawing Sheets

(56) References Cited

U.S. PATENT DOCUMENTS

Figure 1:
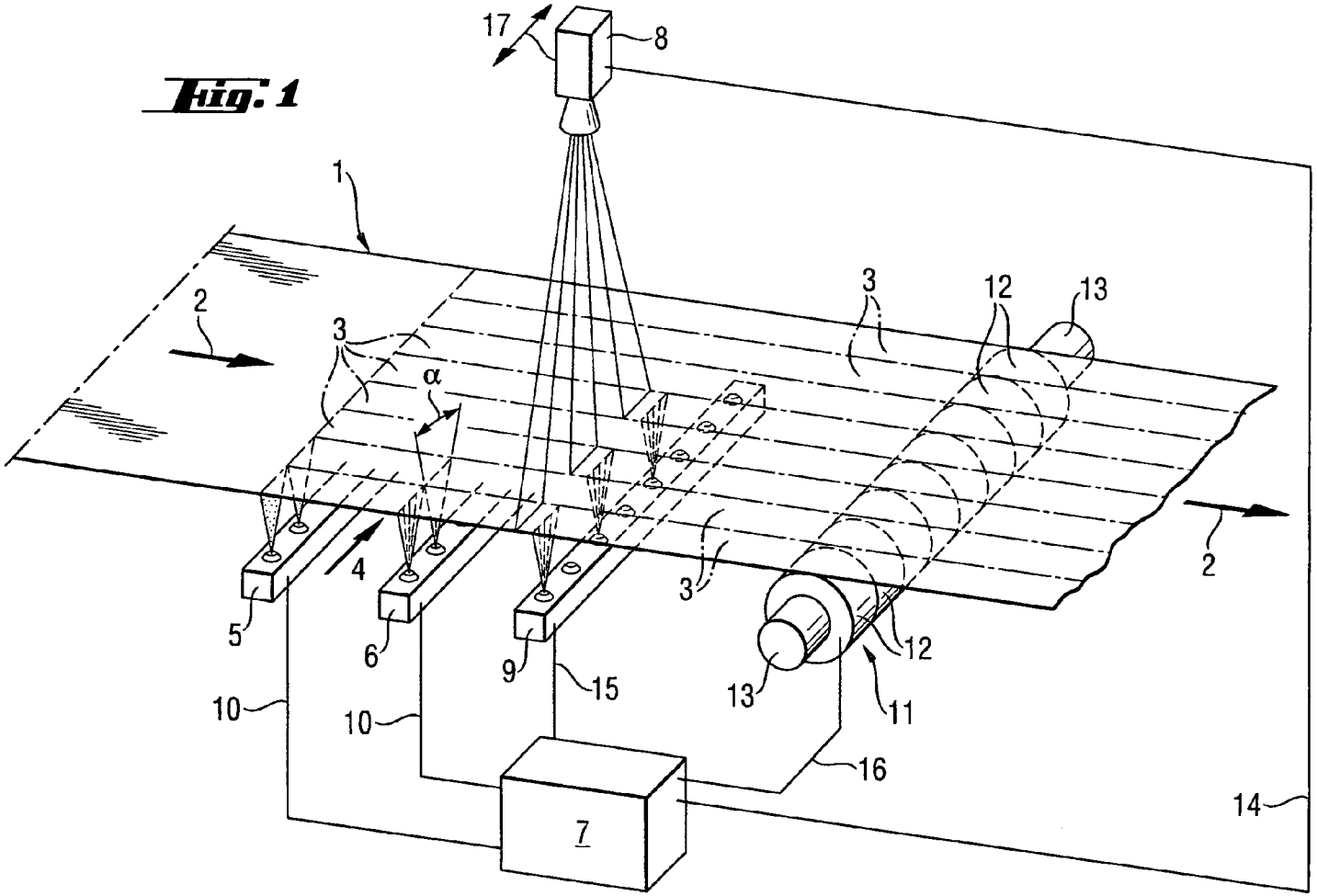

| | | | | | |
|---|---|---|---|---|---|
| 4,392,367 | A | | 7/1983 | Bald | |
| 4,583,387 | A | * | 4/1986 | Thomas et al. | 72/201 |
| 4,596,615 | A | | 6/1986 | Matsuzaki et al. | |
| 4,782,683 | A | * | 11/1988 | Tippins et al. | 72/229 |
| 4,785,646 | A | * | 11/1988 | Uekaji et al. | 72/8.5 |
| 4,899,547 | A | * | 2/1990 | Irwin | 62/63 |
| 5,079,937 | A | * | 1/1992 | Scholer | 72/13.8 |
| 5,212,975 | A | | 5/1993 | Ginzburg | |
| 5,382,306 | A | * | 1/1995 | Plata et al. | 148/511 |
| 5,502,881 | A | * | 4/1996 | Gaydoul | 29/81.08 |
| 5,701,775 | A | * | 12/1997 | Sivilotti et al. | 72/201 |
| 6,027,587 | A | * | 2/2000 | Hodgson et al. | 148/654 |
| 6,204,483 | B1 | * | 3/2001 | Fair et al. | 219/388 |
| 6,615,633 | B1 | | 9/2003 | Akashi et al. | |
| 7,181,822 | B2 | * | 2/2007 | Ondrovic et al. | 29/527.7 |
| 7,303,153 | B2 | * | 12/2007 | Han et al. | 239/461 |
| 7,575,639 | B2 | * | 8/2009 | Cesak et al. | 118/663 |
| 7,718,018 | B2 | * | 5/2010 | Serizawa et al. | 148/661 |
| 7,923,316 | B2 | * | 4/2011 | Park et al. | 438/166 |
| 8,359,894 | B2 | * | 1/2013 | Yoshii et al. | 72/201 |
| 8,414,716 | B2 | * | 4/2013 | Serizawa et al. | 148/654 |
| 8,434,338 | B2 | * | 5/2013 | Armenat et al. | 72/201 |
| 8,500,927 | B2 | * | 8/2013 | Tachibana et al. | 72/201 |
| 2001/0011565 | A1 | * | 8/2001 | Arvedi | 148/546 |
| 2007/0163318 | A1 | * | 7/2007 | Mucke et al. | 72/9.1 |
| 2012/0240651 | A1 | * | 9/2012 | Britanik et al. | 72/12.7 |
| 2013/0054003 | A1 | * | 2/2013 | Weinzierl | 700/153 |

OTHER PUBLICATIONS

Teppo Falt, International Search Report for PCT/FI2008/050394, Sep. 19, 2008.

* cited by examiner

METHOD AND EQUIPMENT FOR FLATNESS CONTROL IN COOLING A STAINLESS STEEL STRIP

This is a national stage application filed under 35 USC 371 based on International Application No. PCT/FI2008/050394 filed Jun. 27, 2008, and claims priority under 35 USC 119 of Finnish Patent Application No. 20070622 filed Aug. 17, 2007.

The present invention relates to a method and an equipment to control flatness in connection with cooling after annealing in a finishing line of a stainless steel strip.

When producing a thin metal strip, such as a thin stainless steel strip, the material for the strip is first hot-rolled to a thickness of 3 mm and then cold-rolled in order to further reduce the thickness. The cold rolling is carried out in several passes through one cold-rolling mill or in several subsequent cold-rolling mills. Cold rolling increases the mechanical strength of the stainless steel, particularly austenitic stainless steel, which mechanical strength is itself desirable for many applications. However, the strips also become practically impossible to work, e.g. to bend, stamp, emboss. It is therefore to anneal the strips upon completion of the cold-rolling process, by heating the strips to a temperature above the recrystallization temperature of the steel, i.e. to a temperature above 1050° C. The strip is then cooled in a cooling box. When heating the strip in the annealing furnace, oxides form on the sides of the strip, partially in the form of oxide scale. The cooled strip is descaled for instance in a shot-blasting machine and then pickled in a pickling bath. After pickling the terminating cold rolling is then achieved as skin-pass rolling. The strip from skin-pass rolling can be used for instance in welding tube manufacturing. Alternatively, the strip from skin-pass rolling can further be treated in an annealing furnace in order to achieve the individual and desired properties for use of the strip in many applications.

When treating the strip in separate stages the flatness of the strip shall control in order to have a good quality for the strip product. The EP patent application 1153673 relates to a metal plate flatness controlling method and device by preventing waviness from occurring at the edge portions of a plate or sheet when it is cooled to the room temperature after completing hot rolling. The method controls the flatness of the metal sheet or plate by homogenizing the surface temperature distribution of the metal sheet or plate through measuring the surface temperatures of the metal sheet or plate at the edge portions and the centre portion across its width between two rolling stands of a tandem finishing mill or at the entry to and/or exit from a reversing finishing mill or after completing hot rolling or after hot levelling and the cooling the metal sheet or plate after completing the finishing rolling. The object of the EP patent application 1153673 is to lead heat onto the surface of the metal sheet or plate in order to maintain a uniform temperature crosswise to the metal sheet or plate before lowering of the temperature during rolling.

The JP patent application 2002-045907 describes a method and a device for controlling flatness of a metal sheet. The surface temperature of the metal sheet is measured between finishing mills of a hot tandem mill or on the outlet of a tandem mill as well as the residual stress of thermal stress, which is generated at the normal temperature, is estimated based on the surface temperature and the residual stress imparted in the width direction with the finishing mill is controlled so that wave shapes are not generated by that residual stress. The object of the JP patent application 2002-045907 is to achieve a flat metal sheet before lowering of the temperature during rolling.

The method and the device described in the JP patent application 2002-045908 is different from the methods and devices of the EP patent application 1153673 and JP patent application 2002-045907 described above that the object of this JP patent application 2002-045908 is to straighten the unflatness, followed from the previous process steps, during hot rolling of thick plates or sheets made of iron, aluminium or titanium using as a cooling medium only water.

The flatness control based on the temperature measurement described in the above mentioned prior art publications, JP patent applications 2002-045907 and 2002-045908 as well as the EP patent application 1153673, relates to the methods to keep the surface temperature distribution of the material before to be rolled in finishing rolling, such as skin-pass rolling, stable in order that a good and uniform rolling result for the flatness is achieved.

The object of the present invention is to create an improved method and equipment in order to control flatness for a thin metal strip through determining the temperature of a thin metal strip during cooling when the thin metal strip is annealed in a finishing line. The essential features of the present invention are enlisted in the appended claims.

In accordance with the present invention a hot thin stainless steel strip from the finishing annealing treatment is conducted through the cooling area, the temperature determination area and the flatness control. The cooling area contains at least two groups of feeding devices for the cooling medium or media, such as nozzles, which are located in an essentially transversal position to the direction of the strip movement so that the cooling effect of one group is extended essentially in the whole area of the strip width. The temperature determination area contains a temperature determination device, which is advantageously located above the stainless steel strip. The temperature determination device is also located so that at least one group of the nozzles is located after the temperature determination device in the direction of the strip movement. The flatness control contains a device, which controls the flatness in the separate areas in the transversal direction of the strip to the direction of the strip movement. The flatness control device is located after the cooling area in the direction of the strip movement and the flatness control device is further located advantageously beneath the strip.

The feeding devices for the cooling medium or media, the temperature determination device and the flatness control device are electrically connected with a central processing unit, such as a computer, which controls the operation of the cooling and flatness control of the invention. The central processing unit also records the data received from the temperature determination device and the flatness control device. The central processing unit utilizes this predetermined and recorded data in the operation control of the feeding devices for the cooling medium or media in the cooling area.

The nozzles, which are used for feeding cooling medium or media to the stainless steel strip in accordance with the invention, are mechanically connected to the source of the cooling medium or to the sources of the cooling media. At least one group of the nozzles located in an essentially transversal position to the direction of the strip movement is located beneath the strip to be cooled. The cooling medium is advantageously water, which is fed onto the strip through the nozzles located beneath the strip. However, the cooling medium is partly also gas, inert gas like nitrogen or argon, and gas is fed onto the strip at least through the nozzles located beyond the strip.

The flatness control according to the invention is carried out using a roll-type control device. This roll-type control device contains a rotatable shaft and the flatness control units are contiguously mounted around the shaft so that the flatness control units are extended at least in the whole area of the strip width. The width of each flatness control unit in the transversal direction of the strip to the direction of the strip movement is preferably essentially the same. The flatness control is divided into zones, which widths represent the widths of the flatness control units. The flatness control units rotate within the rotatable shaft so that the flatness control units have a continuous mechanical contact with the strip.

The temperature determination device is advantageously a thermoscanner, which is installed movable transversally to the direction of the strip movement and which essentially continuously scans the surface of the strip in order to determine the surface temperature of the stainless steel strip. The thermoscanner operates so that the thermoscanner determines the surface temperature of the strip in zones in the transversal direction of the strip to the direction of the strip movement. The widths of the zones for the temperature determination are essentially similar in widths to the zones of the flatness control.

The groups of nozzles in an essentially transversal position to the direction of the strip movement and used for feeding the cooling medium or media onto the surface of the stainless steel strip are located in the width to the strip so that each flatness control zone is provided with one nozzle, and one group of nozzles covers the whole width of the strip. The nozzle is designed so that each nozzle forms an essentially wedge-shaped shower of the cooling medium or media onto that zone whereto the nozzle is directed. Thus each nozzle in one group covers with the cooling medium essentially only one zone on the strip.

When the method and equipment of the invention is in the operation, the hot strip is first precooled in the cooling area wherein by means of a plurality of groups of nozzles inert gas is blasted onto the surface of the strip. In the precooling area at least one group of nozzles is advantageously installed for blasting water as cooling medium on the surface of the strip to be cooled. Then the thermoscanner determines the temperature in separate zones of the strip and the value of the temperature determination in each zone is compared with the data recorded in the central processing unit for the flatness of the strip. When the value of the temperature is essentially different from the predetermined desired value of flatness, the strip is further cooled blasting water through at least one group of nozzles onto the surface of the strip before the flatness control. The value of the flatness control is recorded in the central processing unit and the data is used for adjusting the nozzles at least in the precooling area in order to achieve the desired temperature for the prospective flatness of the whole width of the strip.

The method and equipment of the invention is particularly suitable for the strip which thickness is below 1 millimeter. When desired flatness is achieved within the invention, the speed of the strip in the finishing line is increased and therefore the capacity of the finishing line is also greater.

Figure 2:
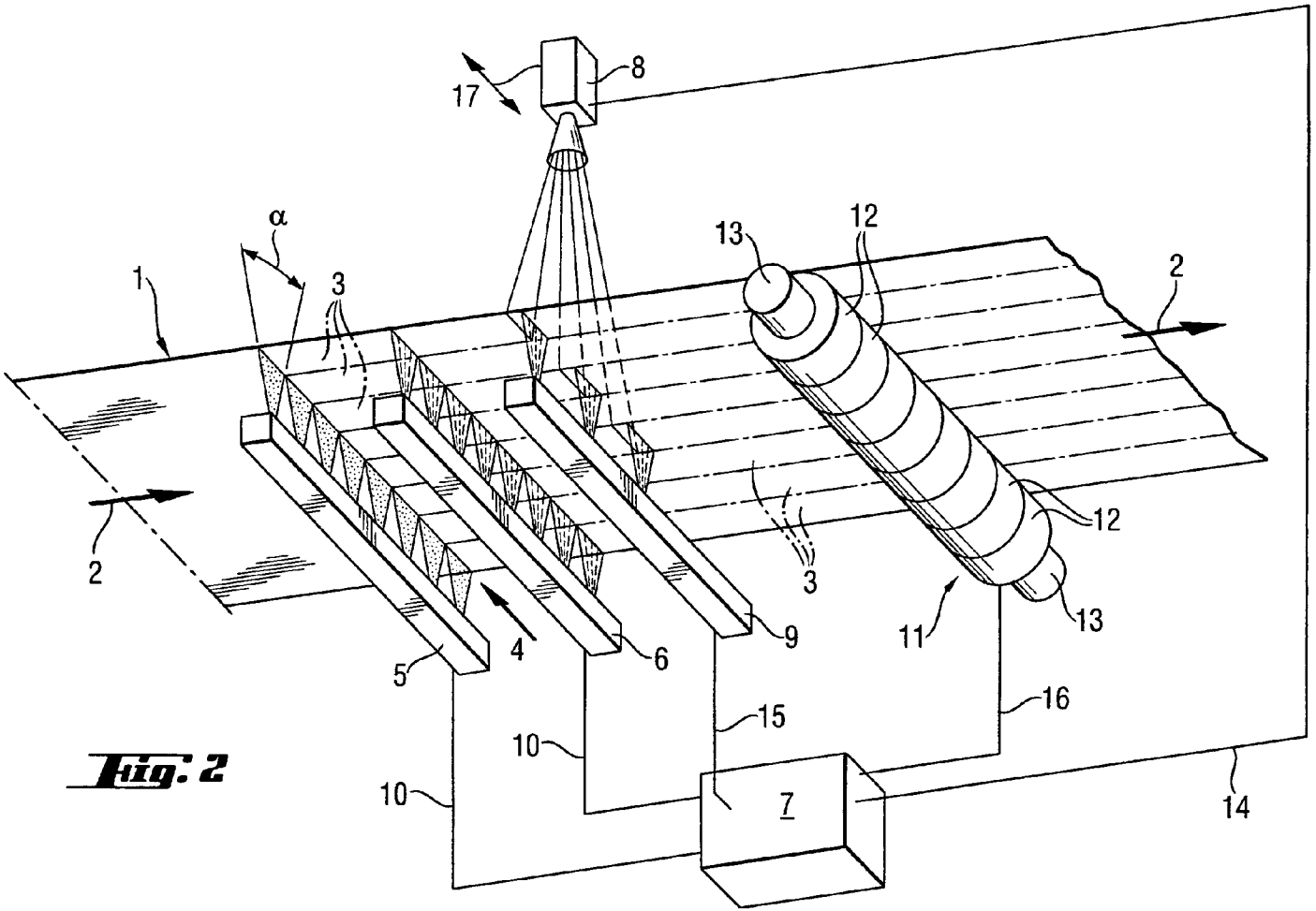

The present invention is described in more details in the following referring to the drawings wherein FIG. 1 illustrates one preferred embodiment of the invention in schematical manner as a view from above and to one side, FIG. 2 illustrates the embodiment of FIG. 1 in schematical manner seen from below and to one side.

In accordance with FIGS. 1-2 the hot strip 1 to be cooled is moving to the direction, which is illustrated by the arrow 2. The strip 1 is by an illustration manner divided into zones 3. The strip 1 goes first through a precooling area 4, which contains groups of nozzles 5 and 6. The nozzles 5 and 6 are mechanically connected with sources of cooling media (not illustrated), and the groups nozzles 5 and 6 are in individual manner, nozzle by nozzle, electrically connected 10 to a central processing unit, a computer 7. The groups of nozzles 5 and 6 are located in a transversal position to the movement direction 2 of the strip 1 in such a way that cooling medium is blasted through one nozzle 5 and 6 in the group to one zone 3 of the strip 1. The nozzles 5 and 6 are constructed so that the cooling media forms a wedge-shaped blast as illustrated in the drawings. The nozzles 5 and 6 are located to the strip 1 so that each nozzle 5 and 6 has the peak angle ($\alpha$) for the wedge-shaped blast between 20 and 30 degrees. The cooling medium fed through nozzles 5 is gas and fed through nozzles 6 the cooling medium is water. The amount of cooling media is adjusted for each separate nozzle 5 and 6 utilizing the predetermined values recorded in the computer 7.

After moving through the precooling area 4 the temperature of the separate zones 3 of the strip 1 is determined with a thermoscanner 8, which is electrically connected 14 with the computer 7. The determined temperature values from the separate zones 3 are recorded into the computer 7, and these new determined temperature values are compared with the predetermined and desired temperature values in each separate zone 3 in the computer 7. When the determined and predetermined desired values of the temperature are different from each other, the group of nozzles 9 having a nozzle for each zone 3, located in a transversal position and after the thermoscanner 8 installed movable transversally shown by the arrow 17 to the movement direction 2 of the strip 1, is utilized to even the differences in the temperature values. The group of nozzles 9 is electrically connected 15 with the computer 7 so that each nozzle 9 is adjusted in individual manner, nozzle by nozzle, to blast water as cooling medium onto the strip 1, when the blast is necessary because of the difference between the predetermined and determined temperature values. The strip 1 is further moved to the flatness control 11. The flatness of the strip 1 is determined utilizing flatness control units 12, which are installed around a rotatable shaft 13 of the flatness control 11. The flatness control units 12 are unit by unit electrically connected 16 with the computer 7 and the flatness control values determined by each unit 12 are recorded in the computer 7. The flatness control units 12 have the same width as the zones 3 which are illustrated in longitudinal direction to the strip 1.

The invention claimed is:

1. A method for controlling flatness of a stainless steel strip during movement of the strip in a direction of strip movement after annealing in a finishing line, the strip having a width transverse to the direction of strip movement, comprising:

feeding the strip sequentially, in the direction of strip movement, through a first cooling station, a second cooling station, a temperature measurement station, a third cooling station, and a flatness control station, in the first cooling station, cooling the strip by feeding at least one cooling medium onto a surface of the strip in a plurality of spray jets distributed transversely of the direction of strip movement over the whole width of the strip, adjusting an amount of the cooling medium fed in the first cooling station in accordance with predetermined data based on a desired temperature of the strip for flatness, in the second cooling station, cooling the strip by feeding at least one cooling medium onto a surface of the strip in a plurality of spray jets distributed transversely of the direction of strip movement over the whole width of the strip, in the temperature measurement station, measuring temperature of the strip, comparing the measured temperature of the strip with the desired temperature of the strip and, if the measured temperature differs from the desired temperature, cooling the strip in the third cooling station by feeding at least one cooling medium onto a surface of the strip in a plurality of spray jets distributed transversely of the direction of strip movement over the whole width of the strip, in the flatness control station, measuring flatness of the strip at a plurality of mutually contiguous locations distributed transversely of the direction of strip movement utilizing a roll-type control device that comprises a rotatable shaft and flatness control units that are contiguously mounted on the rotatable shaft so that the flatness control units extend over at least the whole width of the strip, and controlling the cooling at the first, second and third cooling stations employing a computing device that is electrically connected to the temperature measurement station and the flatness control station.

2. A method according to claim 1, comprising measuring flatness of the strip in a plurality of longitudinal zones of the strip, and measuring temperature of the strip in said plurality of longitudinal zones of the strip.

3. A method according to claim 1, comprising measuring flatness of the strip in a plurality of longitudinal zones of the strip, and wherein each spray jet in the first cooling station sprays cooling medium over a respective one of said plurality of longitudinal zones of the strip.

4. A method according to claim 3, wherein each spray jet in the first cooling station forms an essentially wedge-shaped spray of cooling medium onto the longitudinal zone sprayed by that spray jet.

5. A method according to claim 3, wherein each spray jet in the first cooling station forms an essentially wedge-shaped spray of cooling medium having an apex angle of between 20 and 30 degrees.

6. A method according to claim 3, comprising feeding water as the cooling medium at least one of the cooling stations, and wherein the spray jets that feed water as the cooling medium feed the cooling medium from beneath the strip.

7. Equipment for controlling flatness of a stainless steel strip while cooling the strip during movement of the strip in a direction of strip movement after annealing in a finishing line, wherein the strip has a predetermined width transverse to the direction of strip movement, comprising:

a flatness control device including a plurality of flatness control units for measuring flatness of the strip in respective longitudinal zones of the strip, said longitudinal zones being distributed transversely of the direction of strip movement, a temperature measurement device for measuring temperature of the strip in said longitudinal zones, a first cooling device located upstream of the temperature measurement device relative to the direction of strip movement and including a first plurality of nozzles for feeding cooling medium in a first plurality of spray jets onto a surface of the strip insaid longitudinal zones respectively, a second cooling device located downstream of the first cooling device and upstream of the temperature measurement device relative to the direction of strip movement and including a second plurality of nozzles for feeding cooling medium in a second plurality of spray jets onto a surface of the strip in said longitudinal zones respectively, a third cooling device located downstream of the temperature measurement device relative to the direction of strip movement and including a third plurality of nozzles for feeding cooling medium in a third plurality of spray jets onto a surface of the strip in said longitudinal zones respectively, and a computing device for controlling the cooling devices, the computing device being electrically connected to the temperature measurement device and the flatness control device, and wherein said flatness control device is a roll-type control device that comprises a rotatable shaft and is located downstream of the third cooling device in the direction of strip movement, and the flatness control units are contiguously mounted on the rotatable shaft so that the flatness control units extend over at least the entire predetermined width.

8. Equipment according to claim 7, wherein the nozzles of the first cooling device feed cooling medium over the entire predetermined width of the strip and the nozzles of the second cooling device feed cooling medium over the entire predetermined width of the strip.

9. A method for treating a stainless steel strip during movement of the strip in a direction of strip movement, the strip having a width transverse to the direction of strip movement, the method comprising:

supplying the strip to a finishing line, in the finishing line, feeding the strip sequentially, in the direction of strip movement, through an annealing station, a first cooling station, a second cooling station, a temperature measurement station, a third cooling station, and a flatness control station, in the first cooling station, cooling the strip by feeding at least one cooling medium onto a surface of the strip in a plurality of spray jets distributed transversely of the direction of strip movement over the whole width of the strip, adjusting an amount of the cooling medium fed in the first cooling station in accordance with predetermined data based on a desired temperature of the strip for flatness, in the second cooling station, cooling the strip by feeding at least one cooling medium onto a surface of the strip in a plurality of spray jets distributed transversely of the direction of strip movement, in the temperature measurement station, measuring temperature of the strip, comparing the measured temperature of the strip with the desired temperature of the strip and, if the measured temperature differs from the desired temperature, cooling the strip in the third cooling station by feeding at least one cooling medium onto a surface of the strip in a plurality of spray jets distributed transversely of the direction of strip movement over the whole width of the strip, in the flatness control station, measuring flatness of the strip at a plurality of locations distributed transversely of the direction of strip movement utilizing a roll-type control device that comprises a rotatable shaft and flatness control units that are contiguously mounted on the rotatable shaft so that the flatness control units extend over at least the whole width of the strip, and controlling the cooling at the first, second and third cooling stations employing a computing device that is electrically connected to the temperature measurement station and the flatness control station.

10. A method according to claim 9, comprising measuring flatness of the strip in a plurality of longitudinal zones of the strip, and measuring temperature of the strip in said plurality of longitudinal zones of the strip.

11. A method according to claim 9, comprising measuring flatness of the strip in a plurality of longitudinal zones of the strip, and wherein each spray jet in the first cooling station sprays cooling medium over a respective one of said plurality of longitudinal zones of the strip.

12. A method according to claim 11, wherein each spray jet in the first cooling station forms an essentially wedge-shaped spray of cooling medium onto the longitudinal zone sprayed by that spray jet.

13. A method according to claim 11, wherein each spray jet in the first cooling station forms an essentially wedge-shaped spray of cooling medium having an apex angle of between 20 and 30 degrees.

14. A method according to claim 11, comprising feeding water as the cooling medium at least one of the cooling stations, and wherein the spray jets that feed water as the cooling medium feed the cooling medium from beneath the strip.

15. Equipment for treating a stainless steel strip while cooling the strip during movement of the strip in a direction of strip movement, wherein the strip has a predetermined width transverse to the direction of strip movement, comprising:

an annealer for annealing the strip, a flatness control device including a plurality of flatness control units for measuring flatness of the strip in respective longitudinal zones of the strip, said longitudinal zones being distributed transversely of the direction of strip movement, a temperature measurement device for measuring temperature of the strip in said longitudinal zones, a first cooling device located upstream of the temperature measurement device relative to the direction of strip movement and including a first plurality of nozzles for feeding cooling medium in a first plurality of spray jets onto a surface of the strip in said longitudinal zones respectively, and a second cooling device located downstream of the first cooling device and upstream of the temperature measurement device relative to the direction of strip movement and including a second plurality of nozzles for feeding cooling medium in a second plurality of spray jets onto a surface of the strip in said longitudinal zones respectively, a third cooling device located downstream of the temperature measurement device relative to the direction of strip movement and including a third plurality of nozzles for feeding cooling medium in a third plurality of spray jets onto a surface of the strip in said longitudinal zones respectively, and a computing device for controlling the cooling devices, the computing device being electrically connected to the temperature measurement device and the flatness control device, and wherein the flatness control device is a roll-type control device that comprises a rotatable shaft and is located downstream of the third cooling device relative to the direction of strip movement, and the flatness control units are contiguously mounted on the rotatable shaft so that the flatness control units extend over at least the entire predetermined width of the strip.

16. Equipment according to claim 15, wherein the nozzles of the first cooling device feed cooling medium over the entire predetermined width of the strip and the nozzles of the third cooling device feed cooling medium over the entire predetermined width of the strip.

17. Equipment according to claim 15, wherein the longitudinal zones are contiguous transversely of the direction of strip movement.

* * * * *